United States Patent [19]

Cillieres

[11] 4,445,866

[45] May 1, 1984

[54] LEAD LINE BETWEEN AT LEAST TWO PERSONS, PARTICULARLY FOR CROSS COUNTRY SKIING OR SKI TOURING

[76] Inventor: Jaques Cillieres, 83, chemin des Fontanelles, 31500 Toulouse, France

[21] Appl. No.: 14,362

[22] Filed: Feb. 23, 1979

[30] Foreign Application Priority Data

Feb. 23, 1978 [FR] France ..... 78 05472

[51] Int. Cl.[3] ..... A62B 35/00

[52] U.S. Cl. ..... 434/253; 119/96

[58] Field of Search ..... 35/29 R, 29 B, 29 E; 182/3, 4; 119/96; 224/184, 153, 157, 213; 24/217 R; 403/290, 342; 272/70

[56] References Cited

U.S. PATENT DOCUMENTS

| | | | |
|---|---|---|---|
| 1,409,702 | 3/1922 | Gill | 182/3 |
| 2,612,139 | 9/1952 | Collins | 24/217 X |
| 3,014,284 | 12/1961 | Hall | 35/29 R |
| 3,077,292 | 2/1963 | Gehrke | 119/96 X |
| 3,104,650 | 9/1963 | Grahling | 119/96 |
| 3,295,501 | 1/1967 | Riley | 119/96 |
| 3,347,429 | 10/1967 | Ruth | 224/213 X |
| 3,458,188 | 7/1969 | Infante | 182/4 X |
| 3,973,333 | 8/1976 | Caris | 35/29 R |

FOREIGN PATENT DOCUMENTS

| | | | |
|---|---|---|---|
| 691735 | 5/1953 | United Kingdom | 227/49 |

*Primary Examiner*—Harland S. Skogquist

*Attorney, Agent, or Firm*—Shlesinger, Arkwright, Garvey & Fado

[57] ABSTRACT

A lead line between at least two persons who are moving in a line, particularly on skis, in order to facilitate the movement of the person or persons at the rear; this device includes at least two harnesses, each adapted to be worn by one of the persons, and at least one towline which is made up of an elastic section and safety coupling adapted to be released when a predetermined tension on the towline is exceeded; each towline connects two consecutive harnesses by attachment inclined in the harnesses.

8 Claims, 10 Drawing Figures

LEAD LINE BETWEEN AT LEAST TWO PERSONS, PARTICULARLY FOR CROSS COUNTRY SKIING OR SKI TOURING

This invention relates to a lead line between at least two persons who are moving in a line, particularly on skis, in order to facilitate the movement of the person or persons situated at the rear.

BACKGROUND AND OBJECTS OF THE INVENTION

Forms of sport consisting of individual gliding movement (cross country skiing or ski touring, long distance ice skating . . . ) or rolling movement (roller skating . . . ) are increasingly popular today with the public, where they are considered both as relaxation and as means of maintaining the physical condition. The possibility of practicing these disciplines outside, particularly in family groups, increases their popularity. Thus, cross country skiing or ski touring, for example, have become exceptionally more widespread in the last few years.

But, as in all sports, different levels of expertise exist in the practice of these disciplines: the distance covered and the speed of movement are different according to the training and the physical capacities of each person. Particularly within one family, the father, the mother and the children are generally each at a different level: when these disciplines are practiced in a group, they pose numerous problems and the relaxation is quickly transformed into wearisome exercise, perhaps even dangerous, for certain members of the group. In fact, in a group of persons of different levels of expertise, each must adapt a rate of movement to preserve the togetherness of the group: those who are adept in the discipline must reduce their normal speed and thus lose the benefit of the sport by waiting (reduced distance at reduced speed), while the persons or children who are less trained and less strong must move at speed beyond their physical capacities and thus are exposed to the resulting risks (shortness of breath, muscular fatigue and particularly stress on the heart).

The present invention discloses a lead line between at least two persons who are moving in file, particularly on skis, in order to facilitate the movement of the person or persons situated at the rear, it being understood that the persons situated at the front of the group are at a superior level in the practice of the particular discipline to those situated down the file.

The main object of this device is to equalize a group participating in one of the aforementioned disciplines and comprised of persons of different levels, so as to permit the group on the one hand to adopt a rate of movement which is acceptable to all and on the other hand to cover a satisfactory distance for all. This device consequently permits agreeable group or family practice of the disciplines such as cross country skiing or ski touring.

SUMMARY OF THE INVENTION

To accomplish these objects, the device according to the invention includes at least two harnesses, each adapted to be worn by one person, and at least one towline connecting two consecutive harnesses. This device permits the lead persons, who are adept in the practice of the discipline, to transmit the traction forces to the persons situated to the rear, of lower level of expertise, by means of the towline. There is a distribution of effort within the group and therefore equalization of the group. The harnesses serve to distribute the forces delivered or received by the harness wearer over adequate zones of the body.

According to one characteristic of the invention, each towline between two harnesses is affixed immovably to the front of the rear harness in the line and to the rear of the front harness in the line by attachment means which are adapted to permit attachment to and rapid release from said towline.

According to a preferred embodiment, each harness includes a system of straps including two principal straps forming suspenders and an abdominal or thoracic belt. This system of straps distributes the forces of traction which are received in the back, at the level of the shoulders. It can also include at least one rear auxiliary strap carrying attachment means for the rear towline, particularly mounted to slide along this strap.

Besides, each harness preferably includes regulation means to permit adaptation or adjustment to the body of the person wearing it.

According to another characteristic of the invention, each towline connecting two consecutive harnesses is at least partially elastic. When the towline transmits the traction force, a role of shock absorber is added also, which avoids disturbance of the equilibrium of the person who receives or develops the force of traction, when the force is too jerky.

To avoid the towline being subjected to too great elongation, it can advantageously be comprised of a short elastic section between two nonelastic sections of greater length. According to another characteristic of the invention, each towline is provided with a safety coupling which permits release of the two concerned persons when the traction on the towline becomes greater than a predetermined value. This safety coupling can be arranged between two separate portions of each towline to detach them when a predetermined tension is exceeded.

Thus, if the person being towed falls, that person is released, which considerably reduces the risk of injury by preventing this person from being drawn along the ground after falling. Moreover, the risks of falling to the person towing or to other persons of the group is eliminated.

The safety coupling comprises preferably a male element provided with a head of larger diameter preceded by an inclined portion, and a female element connected therewith provided on the inside with at least one catch. This catch is of a form to fit the inclined portion of the male element and latches with the head of the male element. When a predetermined tension is applied on the two elements the radial elasticity of the catch allows it to be radially displaced and to uncouple the two elements, releasing the head of the male element. Thus, the section of the towline which is integral with one element and the section which is integral with the other element are connected until a predetermined tension is reached and are separated when this tension is attained. After separation, the two sections are reconnected manually.

The radial elasticity of a catch can be assured by that of a blade or furcation on which it is affixed. These blades longitudinally constitute a part of the body of the female element. The adjustment means increases or decreases the free length of each blade so as to increase or decrease the radial elasticity. The release tension is determined according to the weight of the person being towed and the friction coefficient on the displacement surface of the moving element being used (for example skis).

Other characteristics, objects and advantages of the invention will be clear from the following description in regard to the attached drawings, which show several non-limiting examples of embodiments of the invention.

FIG. 1 is a diagrammatic view in perspective of a lead line according to the invention.

FIGS. 1*a*, 1*b*, 1*c* are enlarged fragmentary perspective views of portions of the apparatus of FIG. 1.

DESCRIPTION OF THE INVENTION

Figures 1, 1A, 1B, 1C:
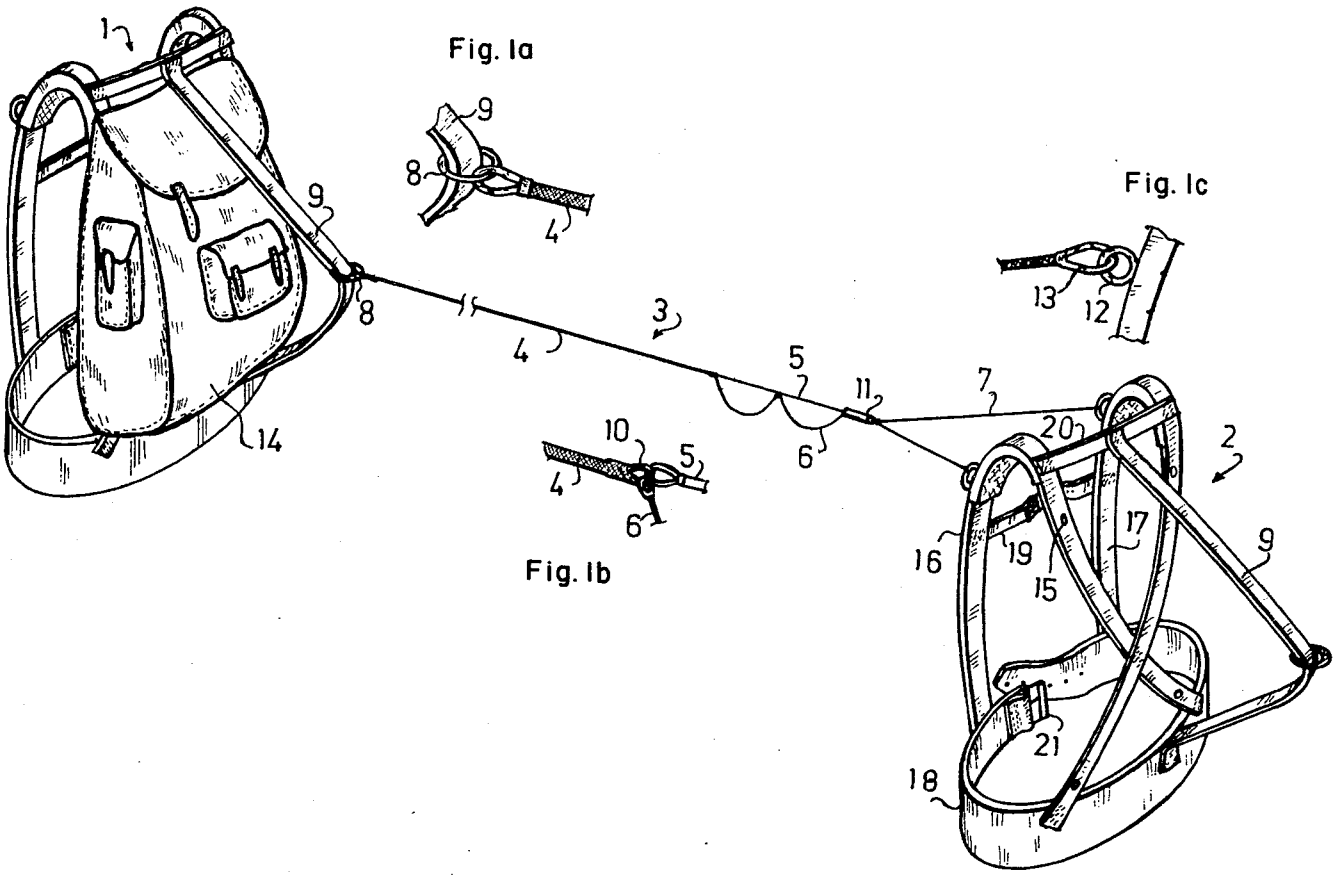

The embodiment shown in FIG. 1 includes two harnesses 1 and 2 connected by a towline 3 on the order of approximately 2.80 m length.

The towline 3 is composed of a front cord 4 affixed to the rear of harness 1 and on the order of 1.50 m in length, a short elastic cable 5 on the order of 0.50 m in length, a small nonelastic cord 6 of greater length than that of cable 5 and which backs up cable 5, and finally a rear cord 7 with two strands of a V-shape, of which the two ends are suitably affixed to the front of harness 2. The cord 7 has a length such that the harness is found at approximately 0.80 m to the rear of the end of elastic cable 5.

Cord 4 is connected to harness 1 by means of a snap device 8 which can slide along a rear strap 9 of the harness as seen in FIG. 1*a*.

Cord 4 and elastic cable 5 as well as small nonelastic cord 6 which backs up cable 5 are connected together to loops 10 by means of traditional eyelets as seen in FIG. 1*c*.

This elastic cable 5 and small cord 6 are connected to cord 7 by a safety coupling 11 which will be described hereinafter.

To avoid the small cord 6 hanging out too far, it can be connected to cable 5 at one or more intermediate points, by means of one or more small rings, as shown in FIG. 1. V-shaped cord 7 is connected to the front of harness 2 by two rings 12 on the harness, by means of a snap device 13 as seen in FIG. 1*c*.

Harnesses 1 and 2 in FIG. 1 are identical, except that the first is provided with an immovable backpack 14 of flexible material which is affixed on it by four snaps 15 shown on harness 2.

Each harness 1 or 2 is composed of two principal straps 16 and 17 forming suspenders, an abdominal belt 18, the aforementioned rear strap 9 and two auxiliary straps 19 and 20, respectively connecting the front and rear tops of suspenders 16 and 17. These two suspenders 16 and 17 are crossed at the rear and are connected at the front and at the rear to abdominal belt 18.

Rear strap 9 is affixed at the top to strap 20, and at the bottom onto abdominal belt 18, and is of sufficient length to permit mounting of backpack 14.

The abdominal belt has a front buckle 21 for securing the harness. It is to be noted that the suspenders can also be provided with buckles which permit regulation of the length. Rings 12, by means of which the traction is carried out, are affixed at the top of suspenders 16 and 17 such that once the harness is in place, they are found to be nearly in the middle of the chest of the harness wearer.

Padding can be provided on the suspenders if desired to soften their contact with the shoulders of the wearer.

Abdominal belt 18 can include a part which has a certain adherence with the clothing of the harness wearer, in order to dismiss any risk of the harness riding up on the chest of the wearer.

Backpack 14 is provided with a side pocket where towline 3 can be stored when not in use.

Figure 2:
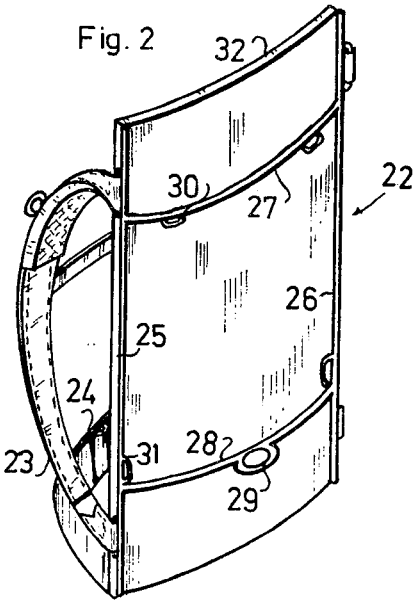
FIG. 2 is a diagrammatic view in perspective of another type of harness.
Figure 3:
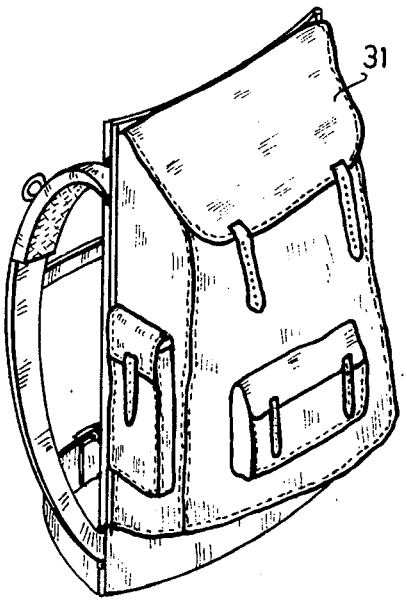
FIG. 3 is a diagrammatic view of such a harness provided with a backpack.
Figure 4:
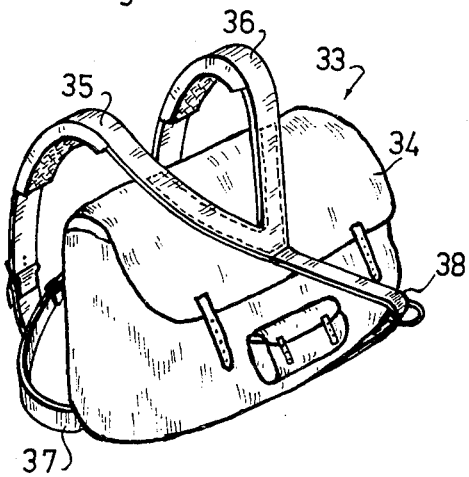
FIG. 4 is a diagrammatic view in perspective of another type of harness with backpack incorporated.

Other embodiments of the harness are shown in FIGS. 2, 3 and 4.

FIG. 2 shows a harness 22 with a rigid framework on the rear, to which are attached the suspenders 23 and abdominal belt 24. This rigid framework is comprised in the example of two essentially vertical shafts 25 and 26 with shafts 27 and 28 between them and slightly arched toward the outside. Suspenders 23 and belt 24 are affixed on each side on vertical shafts 25 and 26.

Shaft 28 has a ring 29 which permits attachment of the towline by means of a snap element, while attachment loops 30 and 31 are provided on shafts 27, 25 and Z6 to hold a backpack by means of hooks which are provided thereon. FIG. 3 shows a backpack 31 attached to the harness.

The examples of FIGS. 2 and 3 show a screen of flexible material provided on the front of the rigid framework in such a manner as to be applied against the back of the wearer of the harness and to make its carriage more comfortable.

FIG. 4 shows a harness 33 which is shorter and has a small flexible backpack incorporated with it. This harness is provided with suspenders 35 and 36 sewn at the bottom onto a thoracic belt 37 which surrounds the thorax of the wearer.

To the rear, suspenders 35 and 36 join and are extended by a strap 38 which permits attachment of the towline. This strap 38 is sewn at the bottom onto thoracic belt 37.

Backpack 34 is sewn onto suspenders 35 and 36 and the rear of thoracic belt 37; it is placed at the top of the back when the harness is in place.

Figure 5:
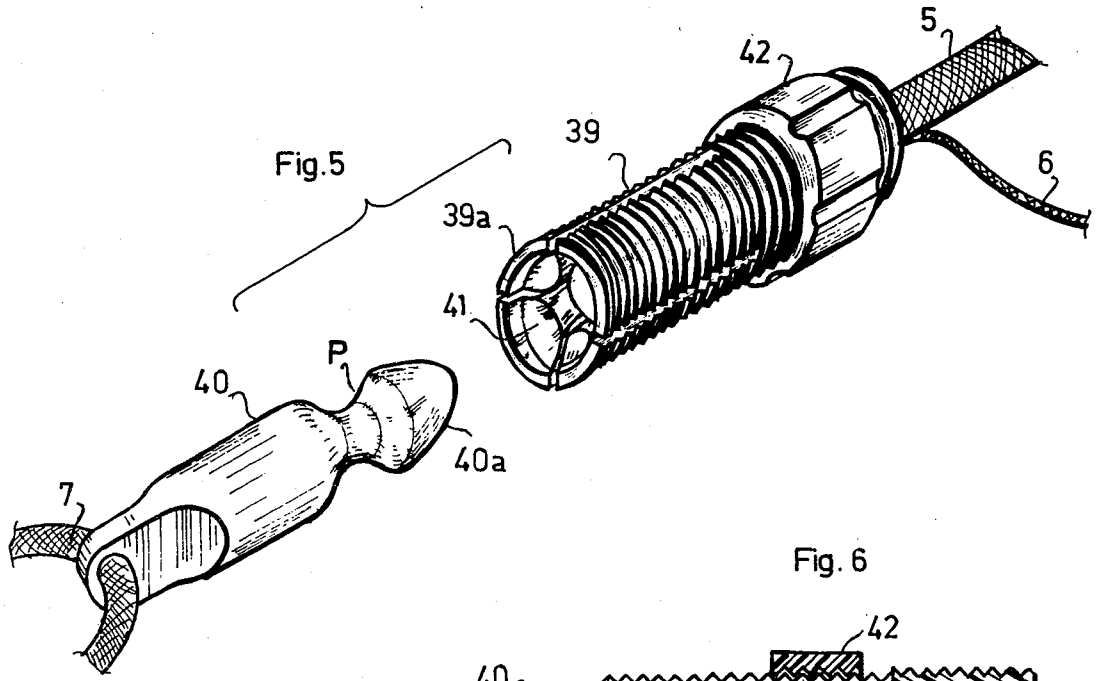
FIG. 5 is a perspective view in larger scale of a safety coupling showing the female and male elements, uncoupled.
Figure 6:
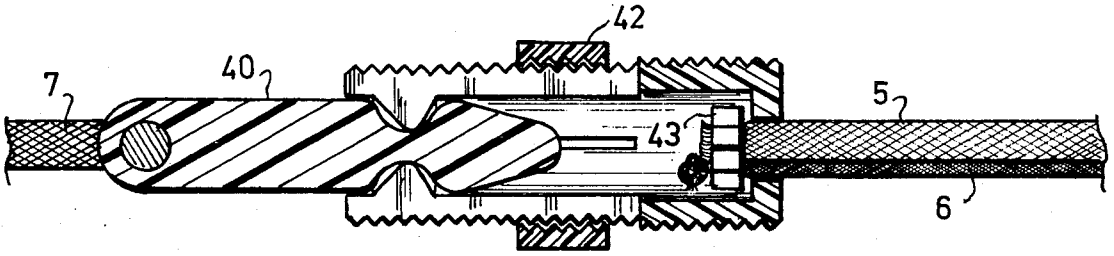
FIG. 6 is a longitudinal cross-section of the connection system showing the male and female elements coupled together.

The safety coupling 11 which is found between elastic cable 5 and cord 7 comprises, as shown in FIGS. 5 and 6, a female element 39 and a male element 40, preferably of molded plastic material. Male element 40 is composed of head 40*a* attached to the body by an inclined portion P. Female element 39 is a threaded cylinder constituted of four flexible blades 39*a* of rounded form. Each blade 39*a* includes a catch 41 of form to fit the inclined portion P of the male element. A ring 42 is screwed on the cylinder and thereby increases or decreases the effective length of lamina 39*a*. Because of this, it increases or decreases the radial elasticity of each catch 41. Male element 40 is affixed on V-shaped cord 7. Elastic cable 5 and small cord 6 are threaded on the inside of female element 39 and are each retained by a tightened ring 43.

A calibration can be provided along element 39 to indicate the disengagement force of male element 40 as a function of the degree to which ring 42 is screwed. The user thus has the possibility of rapid regulation of the release threshold as a function of the weight of the person being towed. For a child approximately 17 kg, for example, this release threshold will be adjusted to be activated from the tension point on the order of 2 kg; for an adult of approximately 50 kg being towed, this threshold of release can be adjusted to about 5 kg.

Figure 7:
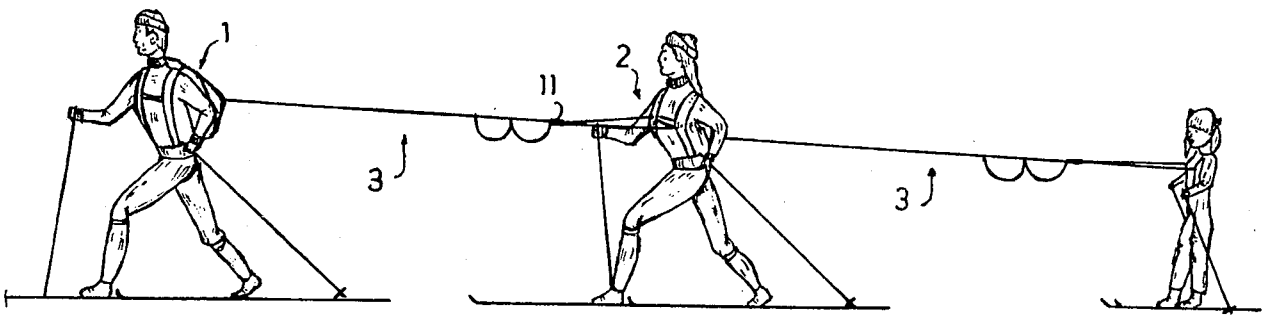
FIG. 7 illustrates the use of a device for ski touring.

The use of the device of the invention is illustrated in FIG. 7 where a family is shown including father, mother, and daughter in the course of a ski tour. The father in this case has the best physical condition and training, and is situated at the head and wearing a harness of the type described which in the example is provided with a backpack. The woman in second position is wearing a harness without backpack; she is aided in her progress by the traction transmitted by the towline. A part of the force of traction which she receives is transmitted to the daughter who also is wearing a harness, adapted to her size.

Experiments have established unexpectedly that the force of traction necessary to equalize a group of very different levels is in fact very low and causes only negligible fatigue for the persons in the front.

For example, a dynamometer placed on the towlines in the two following situations furnished the indications below:

passive tension on flat terrain (absence of movement on the part of the woman and the child) equal to 500 gr mean for a woman of 50 kg and a child of 17 kg.

active traction for the skiers (same weight as preceding, towed at a faster rate than their natural rate) on the order of 100 to 200 gr.

A child who is thus aided can cover a distance on the order of triple that which she would cover alone, at a rate equal to that of an adult.

It is to be noted that small cord 6 which backs up the elastic cable of each towline 3 limits the extension of this cable and deletes risks of cable break, because beyond a very slight extension far below the limit of elasticity of this cable, this small cord is found in taut state and supports extra tensional forces; besides, its presence and the structure of the towline (with a short elastic section between two nonelastic sections) eliminates any possibility of one of the elements of coupling 11 returning toward one of the skiers in case of its release: male element 40 which remains attached to nonelastic cord 7 falls in place, and female element 39 which remains attached to elastic cable 5 and to small cord 6 is subjected to too small a force to be able to cover the entire length of section 4 and thus cannot, in any case, reach the back of the front skier.

Another application of the device for slope skiing consists of pulling a child while riding a ski-lift. In general, the bias of the springs suspending the bars of the ski-lifts do not allow children to use such devices; in fact, children, because they are too light, cannot remain in contact with the snow.

While this invention has been described as having a preferred design, it will be understood that it is capable of further modification. This application, is therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What is claimed is:

1. A device for connecting together at least two persons while skiing one behind another for facilitating the movement of the skier or skiers to the rear comprising at least two harnesses adapted to be worn by consecutive skiers, towline means connecting two consecutive harnesses in front to back relation, said towline means including safety coupling means adapted to disconnect the two skiers when a predetermined tension is exerted on said towline means.

2. A device as in claim 1 and wherein said towline means includes an elastic portion.

3. A device as in claim 2 and wherein said towline means comprises two inelastic portions including a front cord portion comprising one of said inelastic portions connected to the rear of the lead harness and a rear cord portion of V shape having both ends connected to the trailing harness.

4. A device as in claim 3 and wherein said elastic portion is backed up by a third inelastic portion of greater length than said elastic portion when relaxed and connecting said two inelastic portions.

5. A device as in claim 3 or 4 and wherein said safety coupling means connects said elastic portion and the rearmost of said inelastic portions.

6. A device as in claim 5 and wherein said safety coupling means comprises a male member having a head portion attached to a body portion by an inclined portion and a female member having an internal catch adapted to engage said male member adjacent said inclined portion, said catch having a predetermined radial elasticity such as to permit disengagement of said members when a predetermined tension is exerted on said members.

7. A device as in claim 6 and wherein said female member comprises a plurality of flexible blades extending longitudinally from a body portion, said blades each having a catch portion of a complementary shape to said inclined portion of said male member.

8. A device as in claim 7 and wherein said body portion of said female member includes a threaded portion and a ring screwed onto said threaded portion for permitting adjustment of the effective length of said flexible blades for regulating the radial flexibility of said blades.

* * * * *